US006926581B2

(12) United States Patent
Lynders et al.

(10) Patent No.: US 6,926,581 B2
(45) Date of Patent: Aug. 9, 2005

(54) TOY VEHICLE WITH MOVABLE CHASSIS COMPONENTS

(75) Inventors: Michael John Lynders, Shelton, CT (US); James Michael Ferro, Shelton, CT (US); Noah Luther Kislevitz, Cresskill, NJ (US); Androc Luther Kislevitz, Ridgewood, NJ (US); Adam Luther Kislevitz, Englewood, NJ (US)

(73) Assignee: The Obb, L.L.C., Englewood, NJ (US)

( * ) Notice: Subject to any disclaimer, the term of this patent is extended or adjusted under 35 U.S.C. 154(b) by 86 days.

(21) Appl. No.: 10/699,346

(22) Filed: Oct. 31, 2003

(65) Prior Publication Data

US 2004/0092206 A1 May 13, 2004

Related U.S. Application Data

(60) Provisional application No. 60/423,183, filed on Nov. 1, 2002.

(51) Int. Cl.[7] ..... A63H 17/26

(52) U.S. Cl. ..... 446/466; 446/436; 446/437; 446/470

(58) Field of Search ..... 446/436–438, 446/443, 448, 454, 456, 462, 465, 466, 468, 470

(56) References Cited

U.S. PATENT DOCUMENTS

| | | | | |
|---|---|---|---|---|
| 1,443,374 A | | 1/1923 | Mitchell | |
| 2,256,379 A | | 9/1941 | Chaffin | |
| 2,434,693 A | * | 1/1948 | Patrik et al. | 180/41 |
| 3,677,572 A | * | 7/1972 | Fontan et al. | 280/39 |
| 4,530,670 A | | 7/1985 | Ohno | |
| 4,599,078 A | | 7/1986 | Obara | |
| 4,601,519 A | | 7/1986 | D'Andrade | |
| 4,613,927 A | | 9/1986 | Brandt | |
| 4,643,696 A | | 2/1987 | Law | |
| 4,648,853 A | | 3/1987 | Siegfried | |
| 4,674,585 A | * | 6/1987 | Barlow et al. | 180/14.1 |
| 4,717,367 A | | 1/1988 | Stubenfoll et al. | |
| 4,813,906 A | * | 3/1989 | Matsuyama et al. | 446/457 |
| 5,052,680 A | | 10/1991 | Malewicki et al. | |
| 5,129,851 A | | 7/1992 | Villanueva | |
| 5,352,147 A | | 10/1994 | Nagel et al. | |
| 5,487,692 A | | 1/1996 | Mowrer et al. | |
| 5,580,296 A | * | 12/1996 | Chow | 446/443 |
| 5,643,041 A | | 7/1997 | Mukaida | |
| 5,727,985 A | | 3/1998 | George et al. | |
| 5,766,056 A | * | 6/1998 | Tsai | 446/288 |
| 5,919,075 A | | 7/1999 | George et al. | |
| 5,924,910 A | | 7/1999 | Liu | |
| 6,095,890 A | | 8/2000 | George et al. | |
| 6,171,171 B1 | | 1/2001 | Barthold | |
| 6,280,280 B1 | | 8/2001 | Vicino et al. | |
| 6,443,466 B2 | | 9/2002 | Trubiano | |
| 6,589,098 B2 | * | 7/2003 | Lee et al. | 446/465 |

FOREIGN PATENT DOCUMENTS

WO WO 00/07681 A1 2/2000

OTHER PUBLICATIONS

D.J. Malewicki, "ROBOSAURUS™ LIVES! / Creating a Monster", website *http://www.canosoarus.com/02Robosaurus/Robobk01.htm*, (*et seq.*), © 1992, 16 pages (36 sheets).

Search Report for British Patent Office for Application GB0403532.5 dated Aug. 20, 2004, 3 pp.

* cited by examiner

*Primary Examiner*—Jacob K. Ackun
*Assistant Examiner*—Bena B. Miller
(74) *Attorney, Agent, or Firm*—Akin Gump Strauss Hauer & Feld, LLP

(57) ABSTRACT

A toy vehicle comprising a hinged, three part chassis having a first longitudinal end and a second, opposing longitudinal end and including a central chassis portion with first and second lateral chassis portions pivotally coupled with the central chassis portion on the first and second lateral side, respectively, of the central chassis portion. The first and second lateral chassis portions are coupled so as to pivot with respect to the central chassis portion in a common plane and spring biased against the central portion. Each lateral chassis portion includes a pair of road wheels at least one of which is driven by a reversible motor in that chassis portion.

13 Claims, 8 Drawing Sheets

TOY VEHICLE WITH MOVABLE CHASSIS COMPONENTS

CROSS-REFERENCE TO RELATED APPLICATIONS

This application claims benefit of U.S. Provisional Patent Application No. 60/423,183, "Toy Vehicle with Movable Chassis Components", filed Nov. 1, 2002.

BACKGROUND OF THE INVENTION

The present invention relates generally to toy wheeled vehicles and, more particularly, to remotely controlled toy vehicles having unusual play characteristics.

Remotely controlled toy vehicles are well known. One class of known toy vehicle is designed to be able to easily roll over and to be operated on either major side of the vehicle. U.S. Pat. No. 5,429,543, for example, discloses a remotely controlled toy vehicle with six wheels, three wheels on each side. The vehicle is statically balanced such that the vehicle is normally supported by the center pair of wheels and rear pair of wheels. The vehicle is dynamically balanced such that when the wheels of the center pair are driven in opposite directions, the vehicle pitches forward and is supported only by the center pair of wheels. Further, U.S. Pat. No. 5,727,985 discloses a remotely controlled toy vehicle having a chassis with two "front" and two "rear" wheels with balloon tires. The wheels are sufficiently large so as to define an outer perimeter of the vehicle. The location of the chassis is entirely within the perimeter. No portion of the vehicle extends beyond the tires. The resiliency of the tires allows the vehicle to perform a variety of tumbling and deflecting maneuvers. International Patent Publication No. WO00/07681 and related U.S. Pat. No. 6,589,098 disclose a similar vehicle in which a central chassis portion mounts one or a pair of wheel supporting beams, which are pivotally coupled to lateral sides of the central chassis portion so as to rotate in planes perpendicular to a major plane of the vehicle. The design assists the vehicle in being able to climb up and over obstacles that it encounters.

Despite these different variations, toy manufacturers continue to seek other remotely controlled toy vehicle designs offering different functional capabilities and new play patterns.

BRIEF SUMMARY OF TH INVENTION

Basically, the invention is a toy vehicle comprising: a hinged, three part chassis having a first longitudinal end and a second, opposing longitudinal end and including a central chassis portion having opposing first and second lateral sides. A first lateral chassis portion is pivotally coupled with the central chassis portion on the first lateral side of the central chassis portion, and a second lateral chassis portion is pivotally coupled to the central chassis portion on a second lateral side of the central chassis portion. The first and second lateral chassis portions are coupled so as to pivot with respect to the central chassis portion in a common plane. A plurality of road wheels are rotatably supported from the first chassis portion; and another plurality of road wheels are rotatably supported from the second chassis portion.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
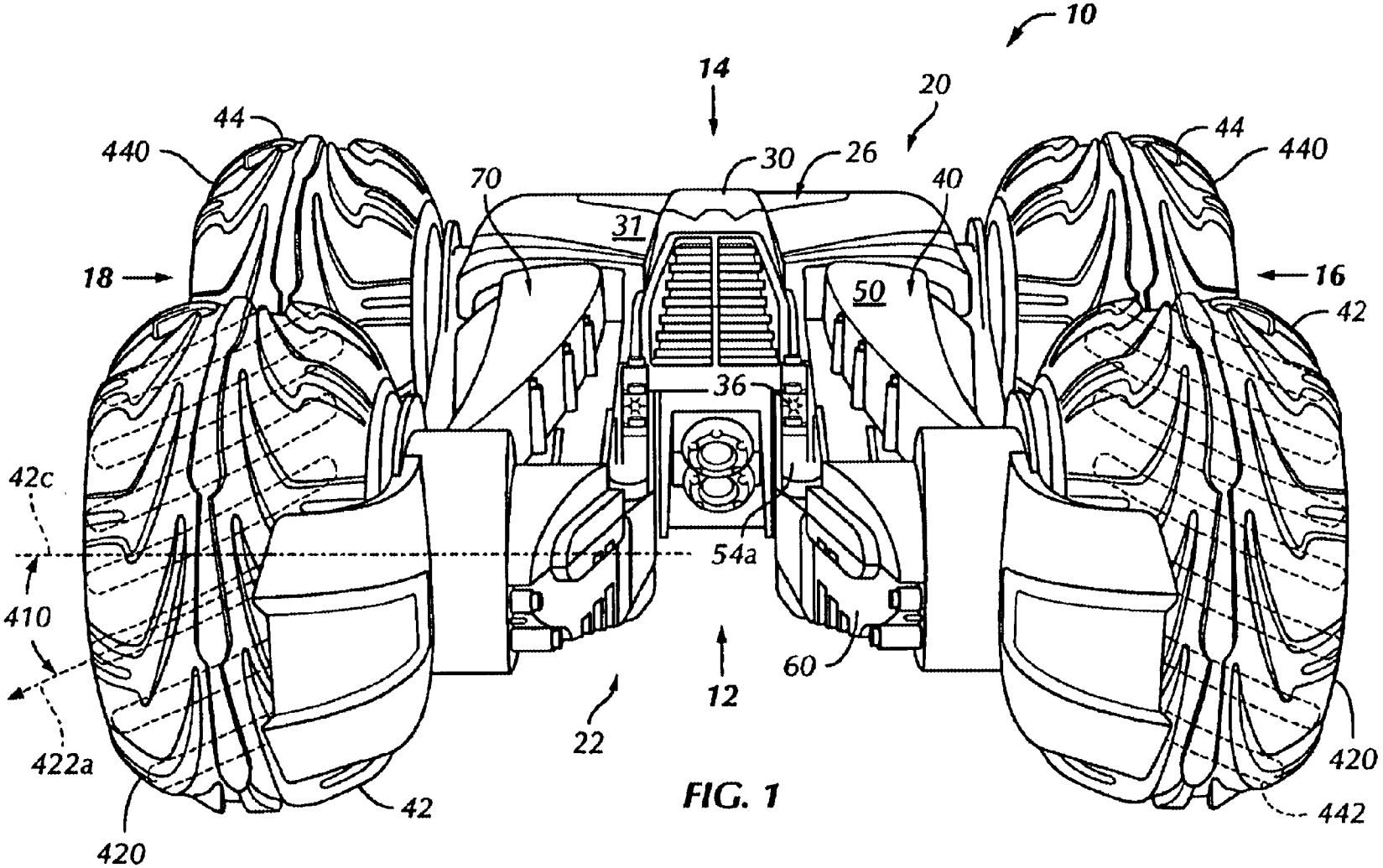
FIG. 1 is a perspective view of a first longitudinal end of a toy vehicle of the present invention, showing a first major side oriented upwards.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the toy vehicle or designated parts thereof. The terminology includes the words above specifically mentioned, derivatives thereof and words of similar meaning.

Referring now to the figures, there is shown a preferred embodiment of a toy vehicle indicated generally at 10, in accordance with the present invention. The vehicle 10 has a first longitudinal end 12, a second, opposing longitudinal end 14, a first lateral side 16 and a second, opposing lateral side 18. Vehicle 10 further has a first major outer side 20 (FIGS. 1 and 3–5) and a second, opposing major outer side 22 (best seen in FIG. 2). The vehicle 10 is particularly characterized by a hinged chassis indicated generally at 26. The hinged chassis 26 includes a central chassis portion 30 and first and second lateral chassis portions 40 and 70, respectively. The first lateral chassis portion 40 is pivotally coupled with the central chassis portion 30 on the first lateral side 16 of the vehicle 10 and the central chassis portion 30. The second lateral chassis portion 70 is a mirror image of the first lateral chassis portion 40 and is pivotally coupled with the central chassis portion 30 on the second lateral side 18 of the vehicle 10 and the central chassis portion 30. A plurality, in particular, two road wheels 42 and 44 are rotatably supported from the first chassis portion 40. Another plurality of identical wheels 42, 44 is rotatably supported from the second chassis portion 70. The first and second lateral chassis portions 40, 70 are coupled with the central chassis portion so as to pivot with respect to the central chassis portion 30 in a common plane, which is parallel to the plane of FIGS. 2 through 5 and to the planes which are simultaneously tangent to all four of the road wheels 42, 44. The pluralities of road wheels 42, 44 are of a size with respect to a remainder of the vehicle such that all four wheels 42, 44 can contact and support either of the first and second major outer sides 20, 22 of the vehicles on a planar support surface so as to be driven with either of the first and second major outer sides 20, 22 facing the planar support surface.

Figure 2:
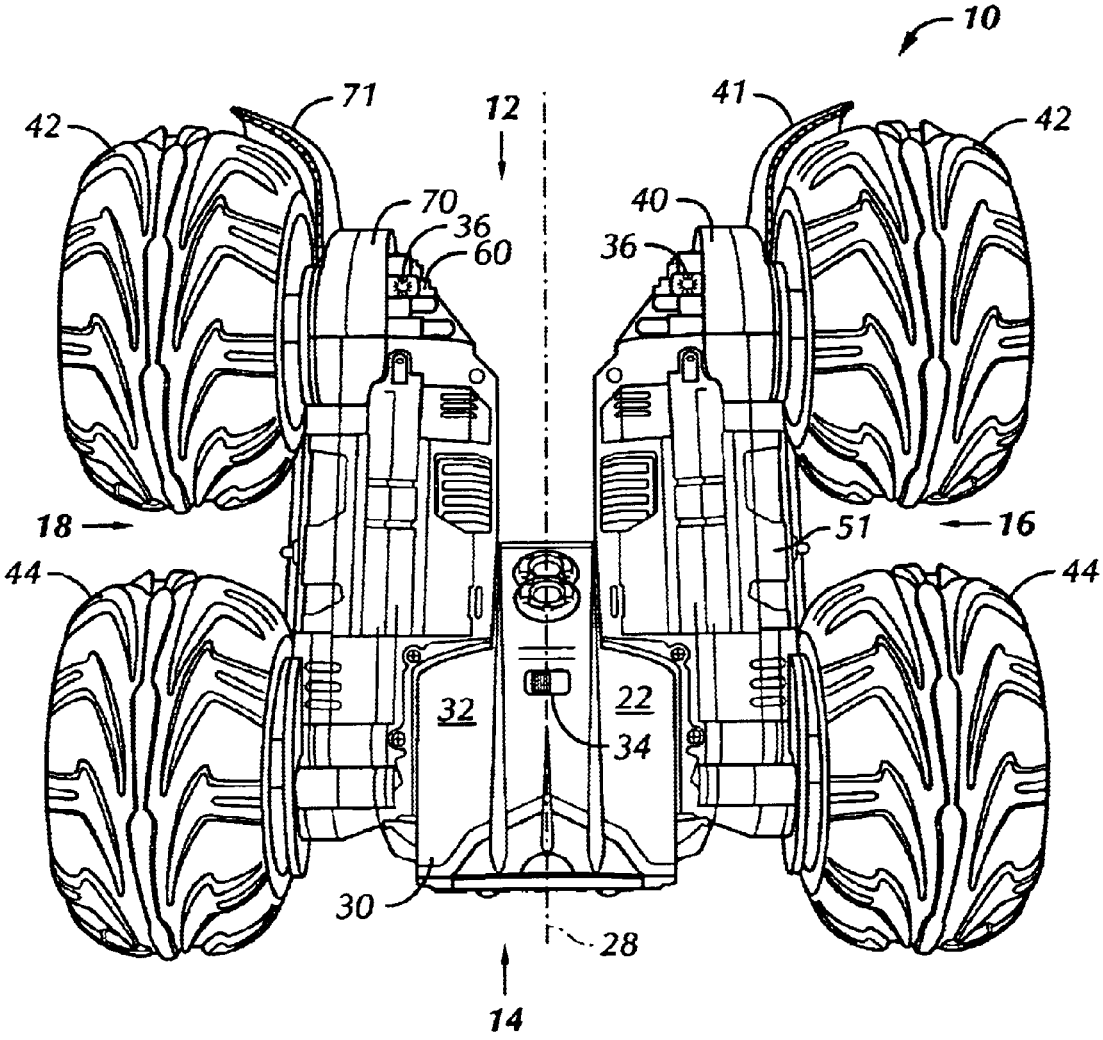
FIG. 2 is a top plan view of a second major side of the toy vehicle of FIG. 1 with first and second lateral chassis portions parallel to one another and pivoted against the central chassis portion.
Figure 3:
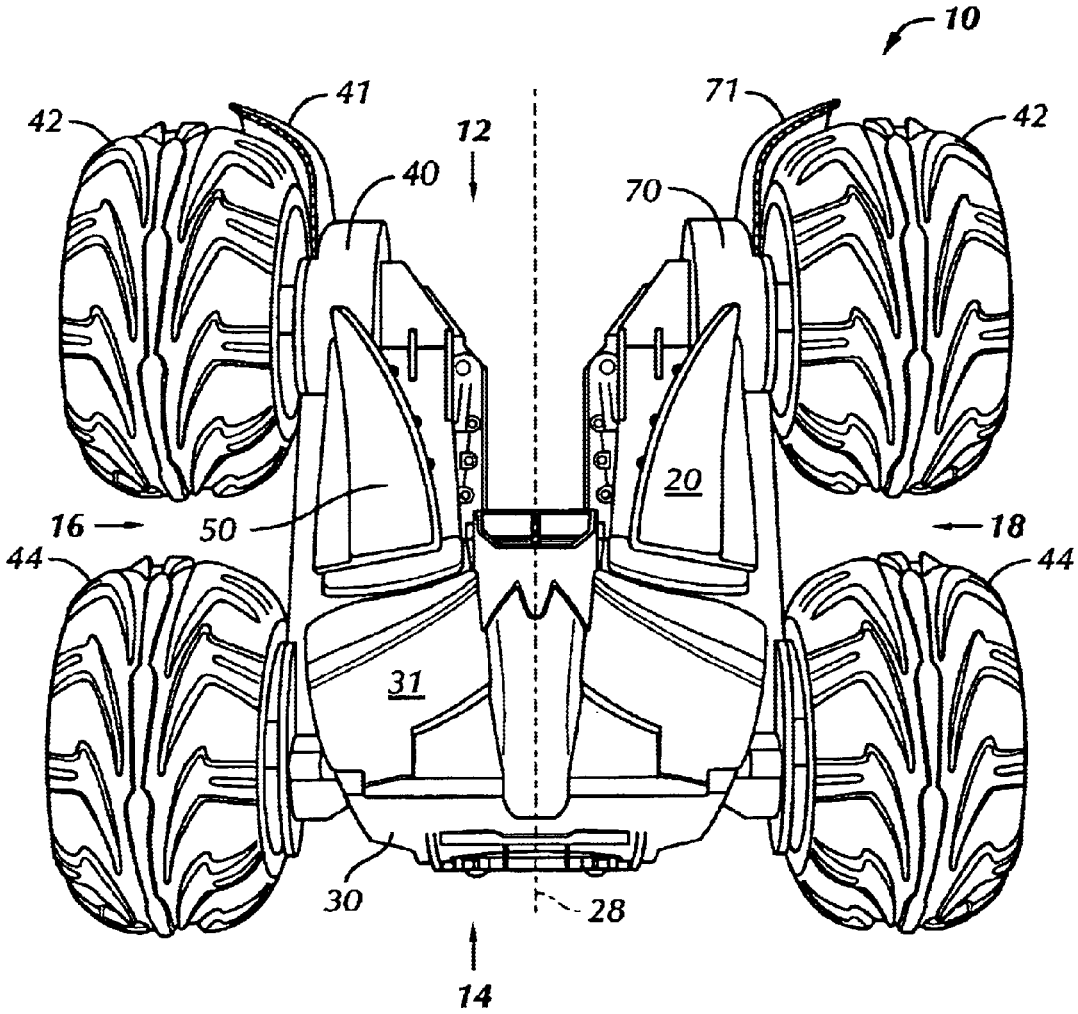
FIG. 3 is a top plan view of the first major side of the toy vehicle of FIG. 1 with first and second lateral chassis portions parallel to one another and pivoted against the central chassis portion.

Since the first and second chassis portions 40 and 70 are mirror images, only the first chassis portion 40 will be described in further detail. The first lateral chassis portion 40 includes a reversible electric motor 46 housed beneath a first cover 50 on the first lateral chassis portion 40. A second cover 51 on the second major planar side 22 of the vehicle 10 is best seen in FIG. 2. The motor 46 is drivingly coupled with at least one road wheel (at least 44) and preferably with each of the road wheels 42, 44 supported on the lateral chassis portion 40 to rotate the driven wheels in the same direction through a drive train (not seen in any of the figures) within the chassis portion 40. The drive train (not depicted) may have any of a variety of known configurations. For example, the drive train may be a spur gear train with a central gear driven directly by the motor pinion, a pair of spur gears driven by the central gear and a pair of wheel gears driven by the spur gears, each wheel gear including a splined drive shaft non-rotatably received in one of the wheels 42, 44. Such a gear train is shown in U.S. Pat. No. 6,589,098, incorporated by reference herein. The wheel gears rotate in the same direction as the central gear.

Figure 4:
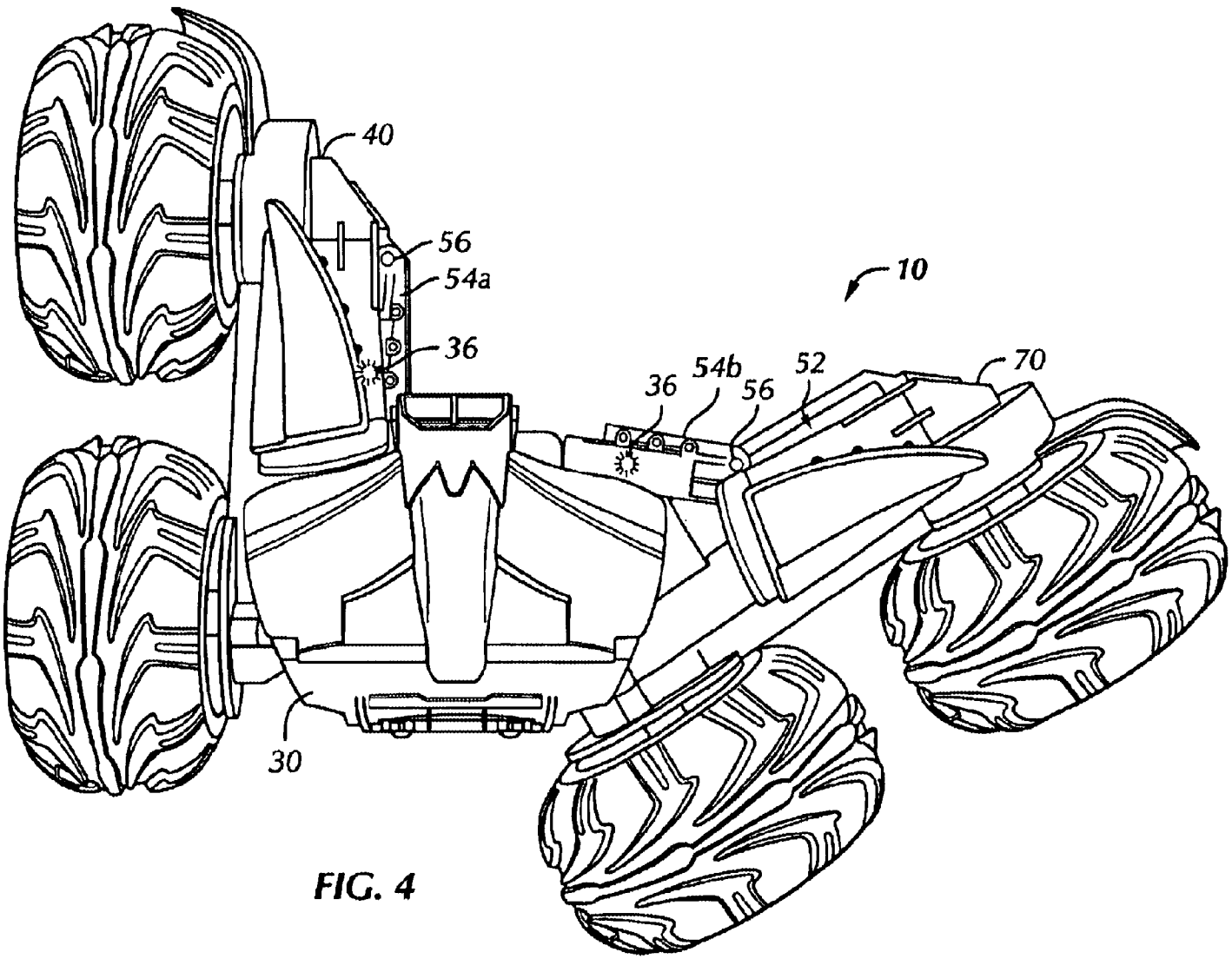
FIG. 4 is a top plan view of the first major side of the toy vehicle of FIGS. 1–3 with a first (right) lateral chassis portion pivoted away from the central chassis portion.
Figure 5:
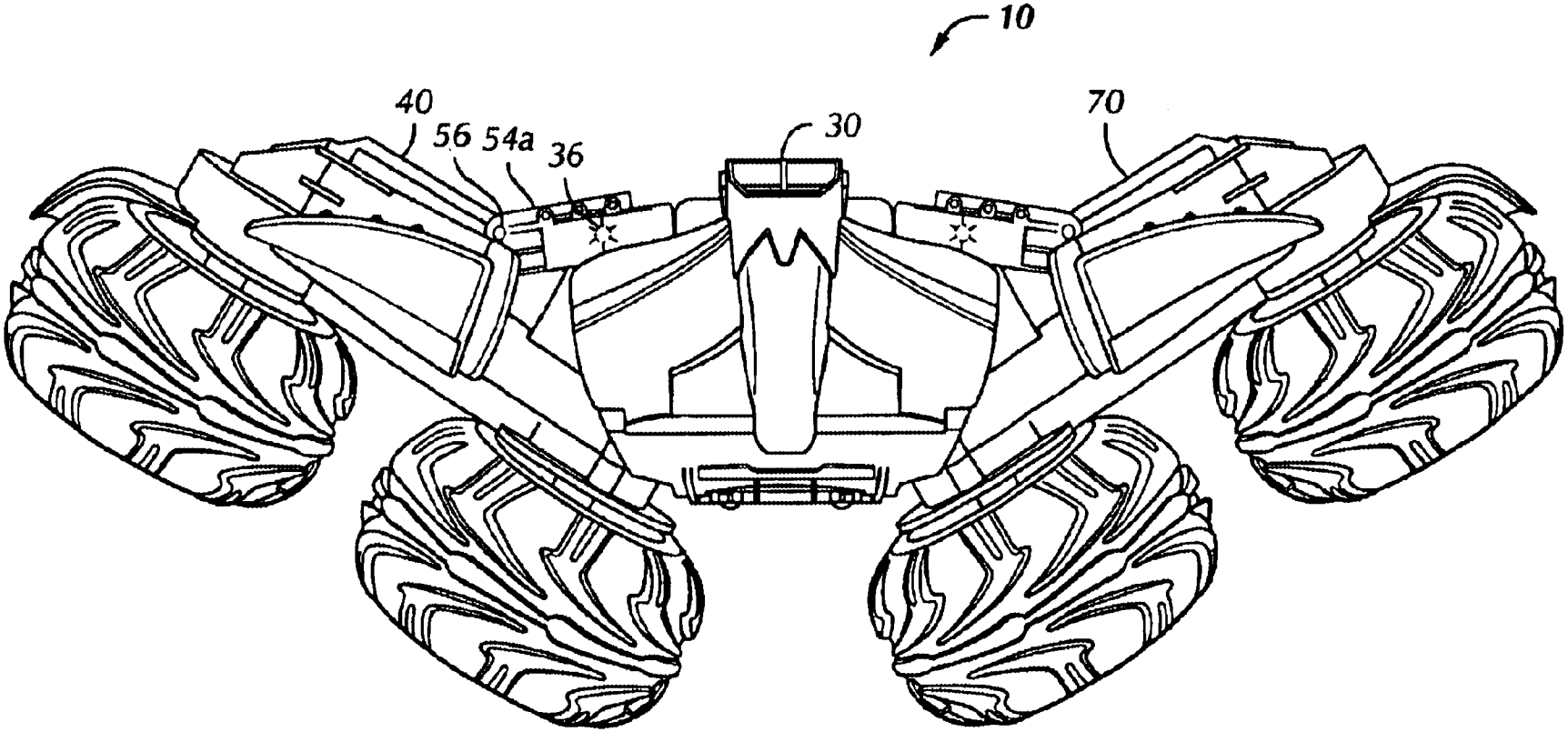
FIG. 5 is a top plan view of the first major side of the toy vehicle with the second (left) lateral chassis portion pivoted away from the central chassis portion.

The first lateral chassis portion 40 is directly pivotally coupled with the central chassis portion 30 at the second longitudinal end 14 of the vehicle. The first longitudinal end 12 of the first lateral chassis portion 40 is free to pivot between an inward position depicted in FIGS. 2 and 3, where it is substantially longitudinally parallel with the central and second chassis portions 30, 70, and a central longitudinal axis 28 through the central chassis portion 30. An outward position of the second chassis portion 70 is illustrated in FIG. 4. In the outward position, the second lateral chassis portion 70 forms an angle of about 40° to 60°, suggestedly approximately 50°, with the central longitudinal axis 28. FIG. 5 illustrates the first lateral chassis portion 40 also pivoted to its most outward position.

Figure 6:
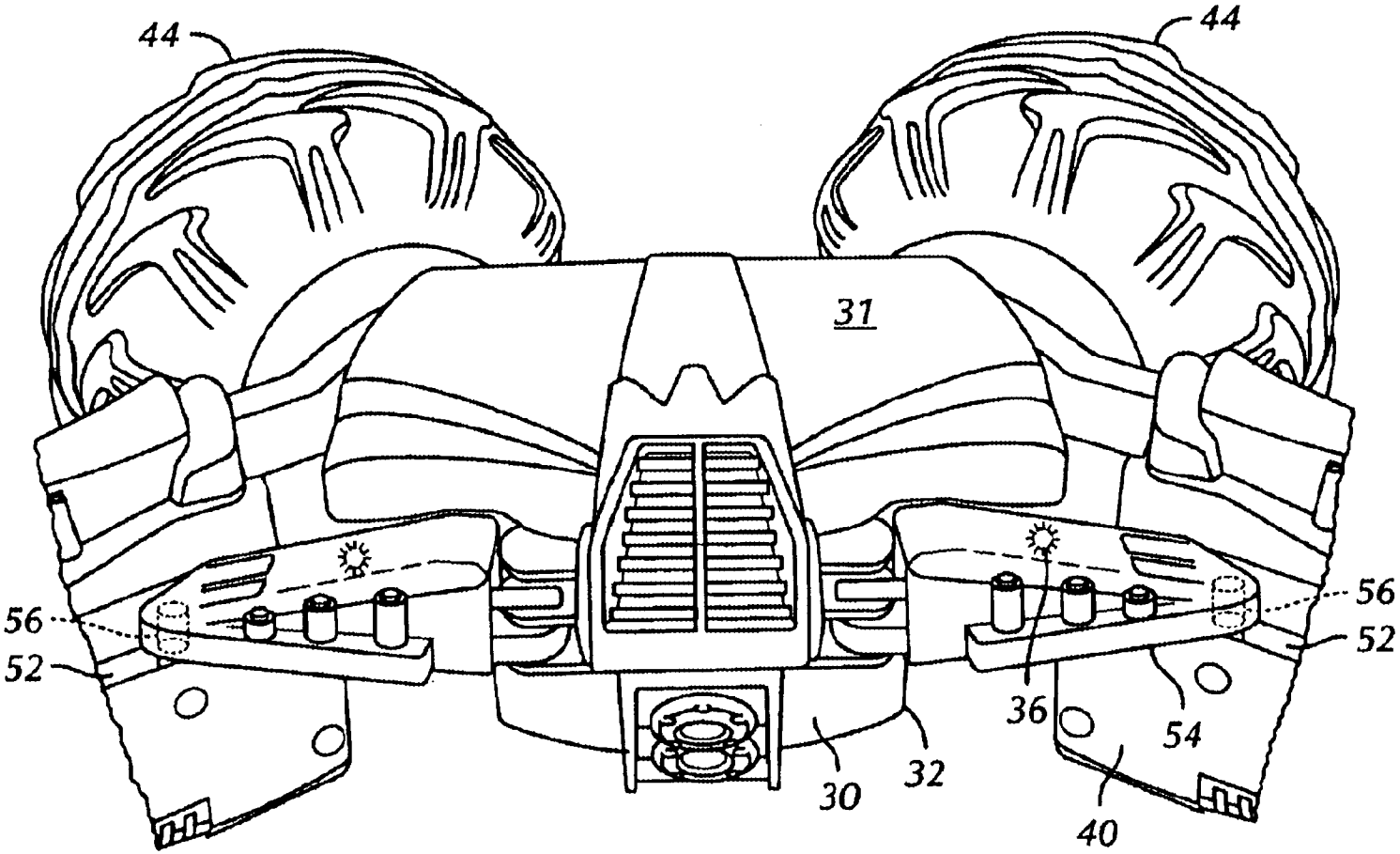
FIG. 6 is a perspective view of the first longitudinal end and first major side of the toy vehicle depicting the pivotal mounting at the central chassis portion of links extending from the central chassis portion to each lateral chassis portion.

The first longitudinal end 12 of the first lateral chassis portion 40 is coupled with the first longitudinal end 12 of the central chassis portion 30 through a first link 54*a*. Link 54*a* has a proximal end pivotally coupled to the central chassis portion 30 and pivots about an axis transverse to the major plane of the vehicle. Referring to FIGS. 4–6, the distal end of the link 54*a* is also provided with a transverse guide member 56 in the form of a pin or pin equivalent, which is received in and slides along a longitudinally extending slot 52 on an inner lateral side of the first lateral chassis portion 40 on the second major planar side of the vehicle 10.

Figure 7A:
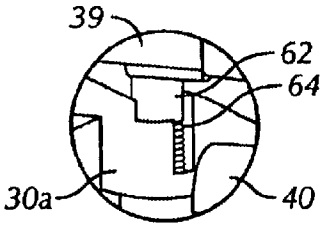
FIG. 7A is a detail view showing a torsional spring biasing the depicted lateral portion against the central chassis portion.
Figure 7:
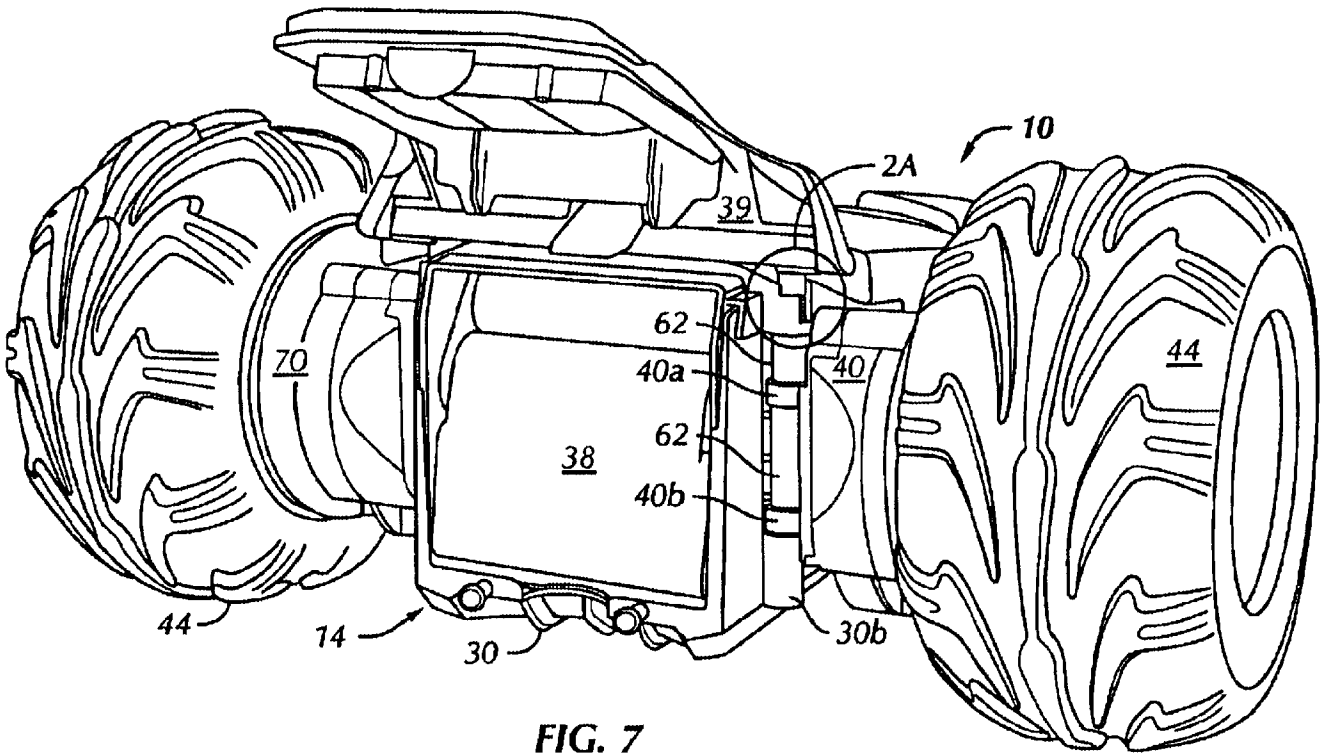
FIG. 7 is a perspective view from a second longitudinal end of the toy vehicle showing pivotal mounting of a second longitudinal end of one of the lateral chassis portions to the central chassis portion.

FIGS. 7 and 7A depict the direct pivotal mounting of the first lateral chassis portion 40 with the central chassis portion 30 at the second longitudinal end 14 of the vehicle 10. The mounting of the second lateral portion 70 is a mirror image. A pivot member 62 (e.g. pin) is transverse to the major plane of the vehicle 10 and extends through overlapping flanges 30*a*, 30*b* of the central chassis portion 30 and 40*a*, 40*b* of the first lateral chassis portion 40. A torsional coil spring 64 is positioned around pivot member 62. A first tang of the spring (not shown) is engaged with a flange of the first lateral chassis portion 40. A second, opposing tang (not shown), is similarly engaged with a flange element of the central chassis portion 30. The torsional coil spring 64 is located to bias the first lateral chassis portion 40 inward towards the central chassis portion 30 and the inward position shown in FIGS. 2 and 3. The bias of the spring 64, however, can be overcome during operation of the vehicle 10 to cause one or both lateral chassis portions 40, 70, to pivot outwardly from the central chassis portion 30. A mirror image link 54*b* (FIG. 4) identically couples the first longitudinal end 12 of the second chassis portion 70 with the central chassis portion 30.

Other elements visible in various figures are first and second body covers 31, 32 on the first and second opposing major sides 20 and 22, respectively, of the central chassis portion 30 and an on/off switch 34 on the second major side 22. Resilient, mirror image fenders 41, 71 are optionally provided at the first end 12 of each chassis portion 40, 70, wrapping partially around the wheels 42. An electric power supply 38 preferably in the form of a rechargeable battery pack is seen in FIG. 7 preferably located at the extreme second longitudinal end 14 of the vehicle 10 on the end of the central chassis portion 30 to shift the center of gravity of the vehicle 10 closer towards the second longitudinal end 14 of the vehicle to assist the vehicle 10 in performing certain types of stunts. Although not required, each lateral chassis portion 40, 70 is provided with a polymer plastic transparent cover 60 at the first longitudinal end 14 of the chassis portions 40, 70 each over a high intensity light emitting diode ("LED") 36 (see FIG. 1). Preferably too, each link 54 is formed from a transparent polymer plastic material and also includes a high intensity LED 36 the locations of which are indicated in FIGS. 1 and 4–6.

Figure 8:
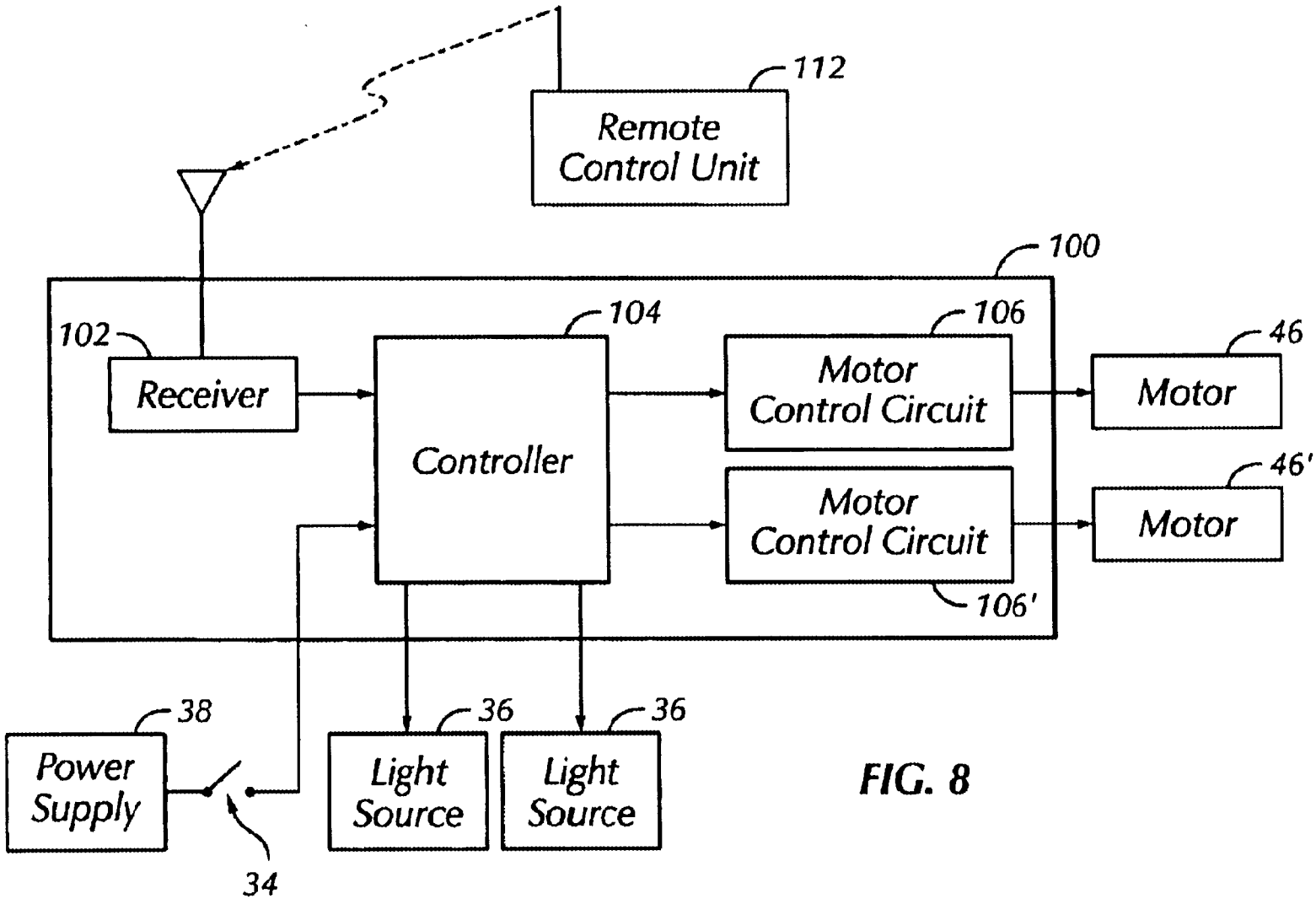
FIG. 8 is a block diagram illustrating electrical components of the toy vehicle of FIG. 1.

Control of itinerant movement of the vehicle 10 is conventional. With particular reference to FIG. 8, the vehicle includes a control circuit 100 preferably in the central chassis portion 30 and including a wireless signal receiver 102, preprogrammed microprocessor controller 104 and motor control circuits 106 and 106', the operation of which are controlled by the microprocessor 104 in response to control signals received by the receiver 102 from a remote control unit 112 generating and transmitting maneuver control signals. While radio frequency (RF) control is preferred, optical (e.g. IR) or sonic (e.g. ultrasound) control is possible. The vehicle 10 is propelled by controlling each motor 46, 46' to rotate the various road wheels 42, 44 in the same direction at the same speed and is steered by controlling the motors to drive the wheels on either lateral side 16, 18 of either lateral chassis portion 40, 70 differently, either in different directions or at different speeds or both. By rotating the wheels 42, 44 on opposite lateral sides 16, 18 in opposite directions, the vehicle 10 can be made to spin in place. Centrifugal force causes the free longitudinal end of each lateral chassis portion 40, 70 at the first longitudinal end 12 of the vehicle 10 to spread apart as seen in FIG. 5. The spreading apart of the lateral chassis portions 40, 70 causes a further shift of the center of gravity of the vehicle 10 towards the second longitudinal end 14 so that, if the vehicle 10 continues to be spun in place, it will raise its first longitudinal end 12 and spin about its second longitudinal end 14 in an upright manner. As can be seen in FIG. 5, vehicle 10 tends to be supported on the corners and sidewalls of its road wheels 44 at the second end 14 of the vehicle 10 during this maneuver. Also during this maneuver, the LED's 36 create an unusual visual effect of concentric light rings, which effect is particularly dramatic in low light environments.

Other unusual maneuvers performed by the vehicle 10 are slip turns and spin outs fostered by the provision of wheels 42 and 44 having different gripping characteristics in order to assist the hinged chassis 26 in unfolding. Preferably, each wheel 42, 44 includes a tire 420 or 440, respectively, preferably on an identical plastic hub, which receives a keyed driveshaft projecting from an outermost gear of the gear train, to drive each of the wheels 42, 44. Preferably, the "front" tires 420 are semi-pneumatic in that they are hollow and open to atmosphere and resiliently flexible so that they can readily collapse and resiliently rebound back to their original shape when impacted against objects. Optionally, the tires 420 provided at the first longitudinal ends ("free "ends) of the first and second lateral chassis portions 40, 70 may be provided with a plurality of "slip strips" indicated in phantom at 422. The strips 422 are preferably removably mounted to each tire 420 as desired by the user and are made of a material (e.g., nylon), which has a lower coefficient of friction than does material forming the tires 420 and 440 (e.g., natural rubber, Kraton or PVC). One possible construction is to provide pairs of holes or slits in the tires 420 at the lateral ends of the treads (i.e. at or near the sidewalls) to receive opposing ends of each slip strip 422. The holes/slits can be sized to frictionally grip the strips and the strips made sufficiently resilient to tend to grip the side of the hole or slits. Other removable mounting configurations can be used. The strips 422 may be removably mounted so the user can change the numbers of strips installed and the relative gripping capability of the front wheels 42 for different vehicle performance. Referring to FIG. 1, the strips 422 are preferably mounted on the tires 420 such that longitudinal axes 422*a* of the strips 422 form an angle 410 traverse to a rotational axis 42*c* of each wheel 42. This is so that the strips 422 are longitudinally aligned with the direction of rotation of the vehicle when the vehicle 10 is spun in place with its lateral chassis portions 40, 70 outwardly displaced. The tires 440 of "rear" wheels 44 are also resiliently flexible and preferably sealed sufficiently to be fully pneumatic and inflatable to provide sufficient rigidity to support the vehicle 10 upright on its end 14 and to retain its toroidal (donut) shape in that position. It is believed that this shape helps the wheels 44 roll while the vehicle 10 is on end 14. However, it is believed semi-pneumatic rear tires 440 could be used if properly designed and if the lesser performance which they might provide is still acceptable. The greater resilience of fully pneumatic rear tires 440 also foster separation of the lateral chassis portions 40, 70 in rear end 14 crashes. If desired, the front and rear tires 420, 440 can be made from different materials having different frictional coefficients to foster slip of the "front" tires 420 the use of slip strips 422.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the scope of the present invention as defined by the appended claims.

We claim:

1. A toy vehicle comprising:

a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane;

a plurality of road wheels rotatably supported from the first chassis portion, at least a first road wheel of the plurality being located proximal the first end of the first chassis portion and at least a second road wheel of the plurality being located proximal the second end of the first chassis portion; and another plurality of road wheels rotatably supported from the second chassis portion.

2. The toy vehicle according to claim 1 wherein each of the first and second lateral chassis portions is pivotally coupled directly with the central chassis portion at the second longitudinal end of the vehicle.

3. A toy vehicle comprising:

a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane, wherein each of the first and second lateral chassis portions is pivotally coupled directly with the central chassis portion at the second longitudinal end of the vehicle;

a plurality of road wheels rotatably supported from the first chassis portion;

another plurality of road wheels rotatably supported from the second chassis portion; and a pair of links, each link being pivotally coupled to the central chassis portion and to a separate one of the first and second lateral chassis portions at the first longitudinal end of the vehicle so as to permit the first longitudinal end of each lateral chassis portion to pivot away from and towards the central chassis portion.

4. The toy vehicle according to claim 3 further comprising a separate light source in each link.

5. The toy vehicle according to claim 3 further comprising at least one spring member positioned to bias at least one of the first and second lateral chassis portions against the central chassis portion.

6. The toy vehicle of claim 5 further comprising an electric power supply located at the second longitudinal end of the vehicle.

7. The toy vehicle according to claim 1 further comprising a electric power supply mounted to the central chassis portion at the second longitudinal end of the vehicle.

8. A toy vehicle comprising:

a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane;

a plurality of road wheels rotatably supported from the first chassis portion;

another plurality of road wheels rotatably supported from the second chassis portion; and a plurality of strips removably attached to an outer circumferential tread surface of at least one road wheel on each of the first and second lateral chassis portions.

9. The toy vehicle according to claim 8 wherein each road wheel includes a resiliently flexible tire and wherein each strip is formed of a material having a lower coefficient of friction than a material forming the tire receiving the strip.

10. The toy vehicle of claim 9 wherein the strips define a non-zero angle with an axis of rotation of the at least one road wheel.

11. A toy vehicle comprising:

a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane; a plurality of road wheels rotatably supported from the first chassis portion; and another plurality of road wheels rotatably supported from the second chassis portion; and wherein each of the first and second lateral chassis portions includes an electric motor drivingly coupled with at least one of the plurality of road wheels rotatably supported on the lateral chassis portion.

12. The toy vehicle of claim 11 wherein each electric motor is reversible and is drivingly coupled with at least a pair of the road wheels rotatably on the lateral chassis portion including the motor.

13. A toy vehicle comprising:

a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane;

a plurality of road wheels rotatably supported from the first chassis portion;

another plurality of road wheels rotatably supported from the second chassis portion; and first and second major opposing outer sides, wherein the pluralities of road wheels are of a size with respect to a remainder of the vehicle such that at least four of the pluralities of wheels can contact and support either of the first and second major outer sides of the vehicle on a planar support surface with either of the first and second major outer sides facing the planar support surface.

* * * * *